United States Patent [19]

Mueller

[11] 4,245,362

[45] Jan. 20, 1981

[54] FLOTATION MATTRESS

[75] Inventor: Leo F. Mueller, Billings, Mont.

[73] Assignee: Watercoil, Inc., Billings, Mont.

[21] Appl. No.: 939,049

[22] Filed: Sep. 1, 1978

[51] Int. Cl.[3] ..... A47C 27/08

[52] U.S. Cl. ..... 5/451; 5/474; 5/476; 267/95; 267/160

[58] Field of Search ..... 5/370, 371, 365, 349, 5/350, 351, 450, 451, 474, 476; 267/95, 160

[56] References Cited

U.S. PATENT DOCUMENTS

| | | | |
|---|---|---|---|
| 2,360,715 | 10/1944 | Perry | 5/350 |
| 2,979,739 | 4/1961 | Krakauer | 5/345 R |
| 3,200,417 | 8/1965 | Costello | 5/260 |
| 3,626,523 | 12/1971 | Robins | 5/345 R |
| 3,735,432 | 5/1973 | Kreten et al. | 5/451 |
| 4,015,219 | 4/1977 | Tinnel | 5/370 |

FOREIGN PATENT DOCUMENTS

| | | | |
|---|---|---|---|
| 496756 | 4/1930 | Fed. Rep. of Germany | 5/351 |
| 11816 | of 1897 | United Kingdom | 5/348 |
| 830185 | 3/1960 | United Kingdom | 5/351 |

*Primary Examiner*—Roy D. Frazier
*Assistant Examiner*—Alexander Grosz
*Attorney, Agent, or Firm*—John J. Byrne; Edward E. Dyson

[57] ABSTRACT

Disclosed is a flotation mattress comprising (a) a planar, flexible bag (10) adapted to hold water during use of the mattress, (b) a hollow, annular compartment (12) surrounding the bag (10) in the plane of the bag, the compartment (12) being collapsible in the direction perpendicular to the plane of the bag (10), (c) a plurality of springs (14, 42, 56) disposed in the compartment (12) with their axes of resiliency perpendicular to the plane of the bag (10), the springs (14, 42, 56) biasing the compartment (12) towards its uncollapsed position, and (d) means (20, 34, 36, 38) for maintaining the horizontal stability of the planar, flexible bag (10) while the mattress is in use.

29 Claims, 12 Drawing Figures

FIG. 6
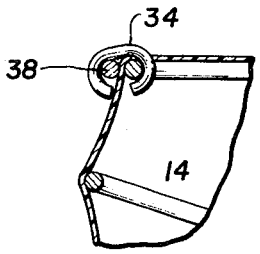
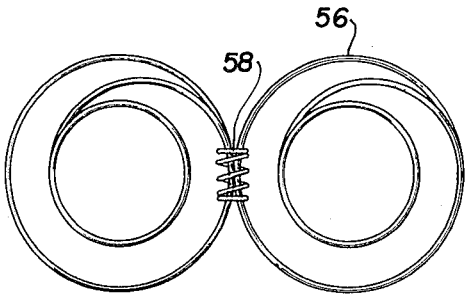
FIG. 11
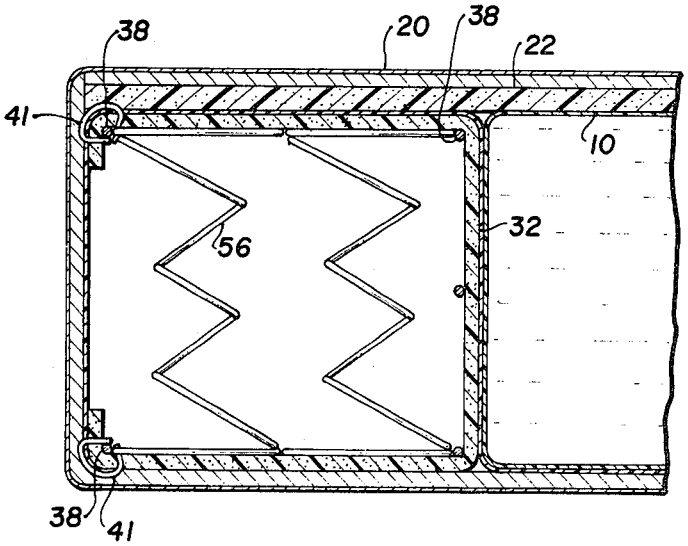
FIG. 12

FIG. 7
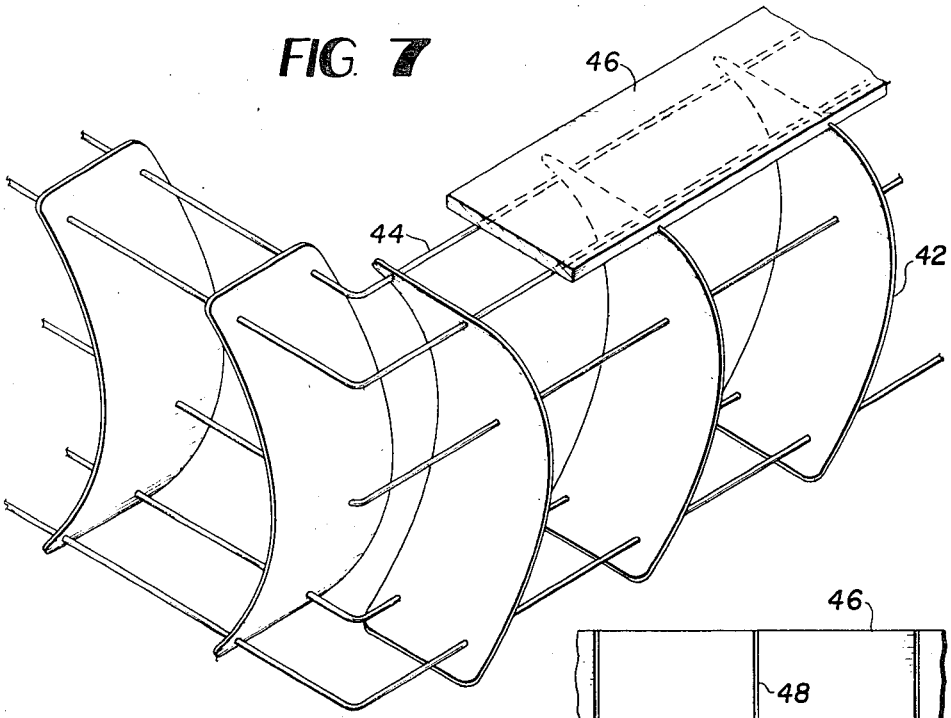
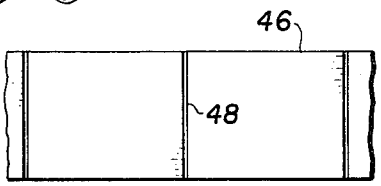
FIG. 8
FIG. 9
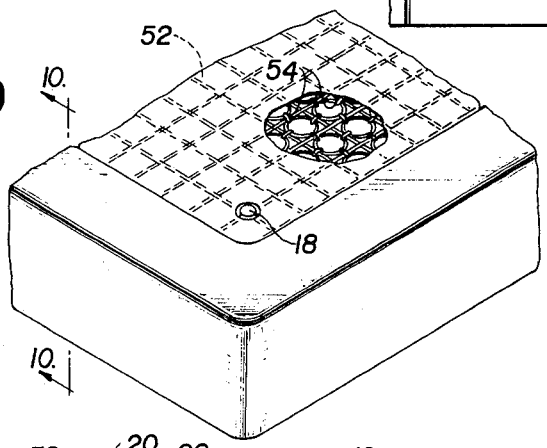
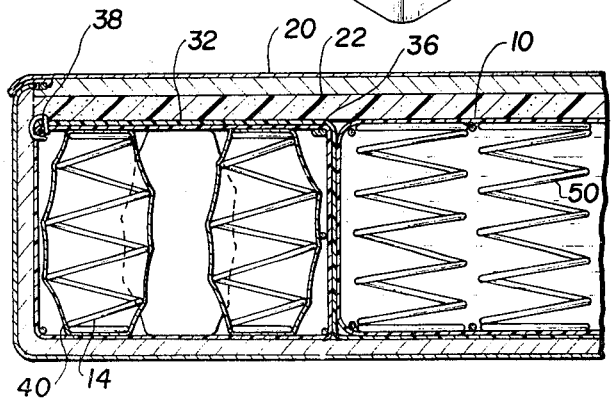
FIG. 10

FLOTATION MATTRESS

TECHNICAL FIELD

This invention relates to mattresses of the type used for human beds. In particular, it relates to mattresses for beds of the type which can be referred to as "waterbeds" or "flotation" beds.

BACKGROUND OF THE INVENTION

The first generation of waterbeds merely consisted of large plastic bags. They were oftentimes approximately 2-½ feet deep and contained several hundred gallons of water. These waterbeds proved to be heavy enough to pose a threat to the integrity of floors on which they were disposed and to the safety of their users.

A second (and still used) generation of waterbeds utilizes a one-foot thick plastic mattress bag on a platform provided to maintain the mattress off the floor. A queen size unit of this type utilizes approximately 160 gallons of water, weighing approximately 1800 pounds.

A third generation of waterbeds, exemplified by those disclosed in U.S. Pat. No. 4.062,077 to Autrey et al. and in U.S. Pat. No. 4,015,299 To Tinnel, offer the benefits of water flotation in combination with some features of traditional mattresses. Such waterbeds consist of a mattress about six inches deep disposed on a wood base. The reduction in depth of such mattresses realizes an important saving in weight. However, the mattress can expand laterally when someone sits or lies on it. Such expansion is not only unattractive at point of sale, but the disrupting or tearing of bed coverings can result. The U.S. patent to Tinnel describes a unit wherein a mattress is circumscribed by a rigid box to prevent lateral expansion. Autrey provides a rigid circumscribing board about the water bag for that purpose. Cushions of resilient padding over and on the outside of the aforementioned rigid frameworks are employed to diminish the feel of the framework.

However, rigid peripheral units can prove to be uncomfortable in use. The rigid framework can oftentimes be felt through the resilient padding. Others in the art, such as Tinnel, use a circumscribing foam rubber periphery. However, it is difficult, in practice, to match the resiliency characteristics of the water bag with the resiliency characteristics of the foam rubber peripheral cushions. A feeling of two distinct zones in the mattress is disconcerting to users of the mattress. Moreover, foam rubber cushions tend to degrade with hard use over a long period of time.

OBJECTS OF THE INVENTION

It is, therefore, a general object of the invention to provide a waterbed which will obviate or minimize problems of the type previously described.

It is a particular object of the invention to provide a waterbed which has a relatively low weight, yet which offers the benefits of water flotation.

It is a further object of the invention to provide a waterbed mattress whose outer dimensions, especially its peripheral configuration, do not expand when someone sits or lies on it, yet feels uniformly resilient to the user across the entire upper surface of the mattress.

Other objects and advantages of the present invention will become apparent from the following detailed description of several preferred embodiments thereof taken in conjunction with the accompanying drawings.

BRIEF SUMMARY OF INVENTION

The foregoing objects of the invention are achieved by a waterbed mattress comprising (1) a planar, flexible bag adapted to hold water during use of the mattress, (2) a hollow, annular compartment surrounding the bag in the plane of the bag, the compartment being collapsible in the direction perpendicular to the plane of the bag, (3) a plurality of springs disposed in the compartment with their axes of resiliency perpendicular to the plane of the bag, the springs biasing the compartment towards its uncollapsed position, and (4) means for maintaining the horizontal stability of the planar, flexible bag while the mattress is in use.

BRIEF DESCRIPTION OF THE DRAWINGS

FIG. 6 is a fragmentary detail view showing a portion of the internal construction of either of the first two embodiments.

FIG. 7 is a fragmentary perspective view of a third embodiment of the subject invention.

FIG. 8 is a fragmentary bottom view on a reduced scale of one element of the embodiment shown in FIG. 7.

FIG. 9 is a fragmentary perspective view with portions cut away of a fourth embodiment of the subject invention.

FIG. 10 is a view along the line 10—10 in FIG. 9.

FIG. 11 is a fragmentary plan view of a portion of a fifth embodiment of the subject invention.

FIG. 12 is a fragmentary detail view showing a portion of the internal construction of the fifth embodiment.

DETAILED DESCRIPTION OF THE PRESENTLY PREFERRED EMBODIMENTS

Figure 1:
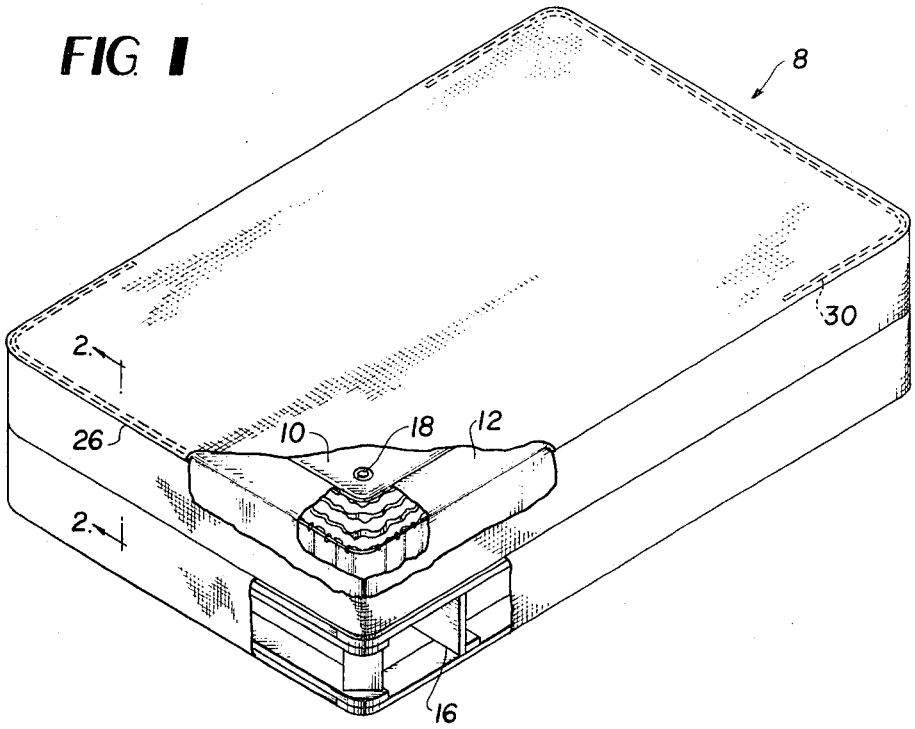
FIG. 1 is a perspective view with portions cut away of the presently preferred embodiment of the subject invention.

Referring now to the drawings wherein like numerals indicate like parts, the numeral 8 indicates the flotation mattress of this invention. In particular, the flotation mattress depicted in FIGS. 1 and 2 comprises a planar, flexible bag 10 having a generally vertical peripheral sidewall and being adapted to hold water during use of the mattress, an annular compartment 12 surrounding the bag 10 in the plane of the bag and being collapsible in the direction perpendicular to the plane of the bag, and an annular spring assembly comprising a plurality of coil springs 14 disposed in the compartment 12 with their axes of resiliency perpendicular to the plane of the bag 10 and biasing the compartment 12 towards its uncollapsed position, the spring assembly having an inner wall juxtaposed in close proximity to the side wall of the bag. As shown in FIG. 1, the mattress is adapted to be disposed on a framework 16 which maintains the mattress off the floor during use.

The bag 10 is preferably made of 20 mil vinyl, and it is preferably about six inches thick when filled with water. Its lateral dimensions are, of course, selected to suit the size of the bed with which the mattress is to be used. Heater and vibrator means (not shown) may be disposed under the bag 10 in a manner well known to the art, and a valve 18 is provided to fill and empty the bag 10 in a manner also well known to the art.

Figure 3:
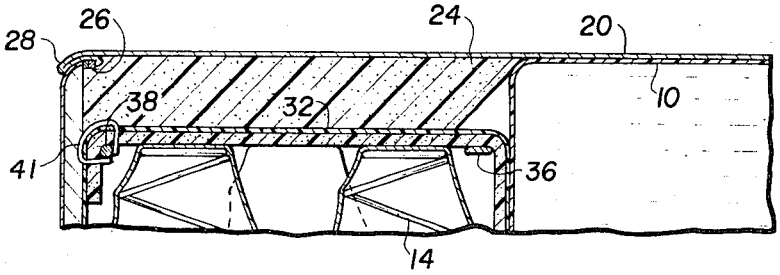
FIG. 3 is a fragmentary perspective view of a portion of a second embodiment of the subject invention.
Figure 4:
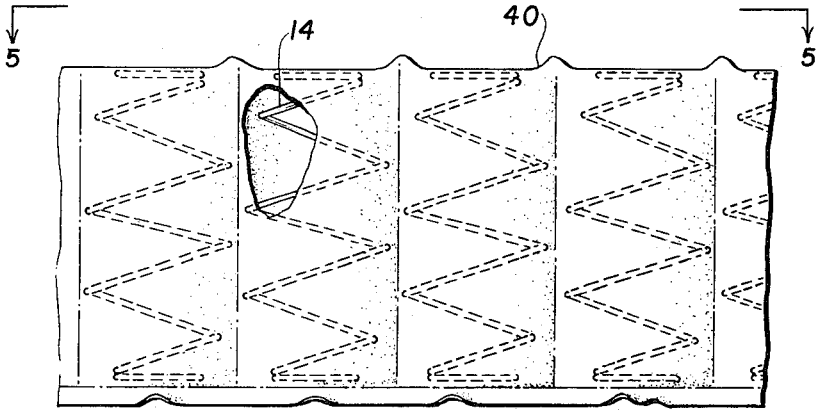
FIG. 4 is a fragmentary detail view showing a portion of the internal construction of either of the first two embodiments.
Figure 5:
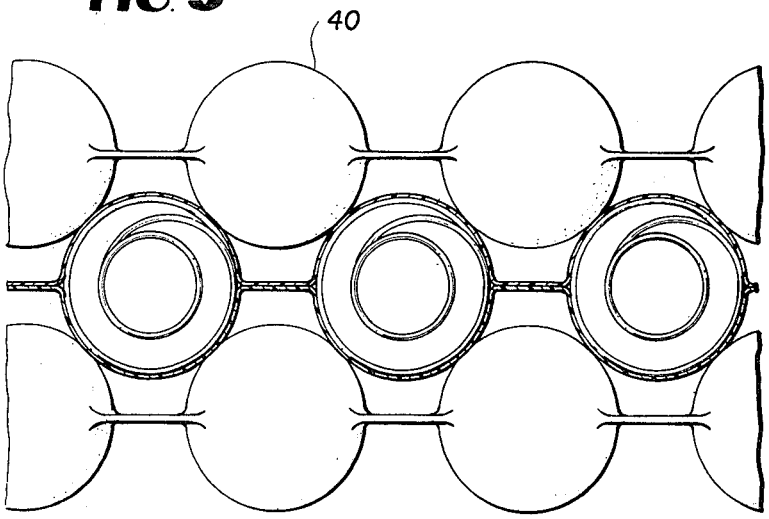
FIG. 5 is a view along the line 5—5 in FIG. 4.

A resilient half inch quilted, padded ticking 20 surrounds the bag 10 and the compartment 12. Beneath the top layer of the padded ticking 20 is a one-inch foam insulation pad 22 on the top of the bag 10 and the compartment 12. It should be particularly noted that the presence of the foam insulation pad 22 reduces the need for a water heater. Alternatively, as shown in FIG. 3, the compartment 12 can be of less depth than the bag 10, and an annular foam insulation pad 24 can be provided which overlies only the compartment 12. The padded ticking 20, which entirely surrounds the other elements of the mattress and which is substantially inelastic, serves to aid in the prevention of lateral expansion of the mattress when someone sits or lies on the mattress.

Figure 2:
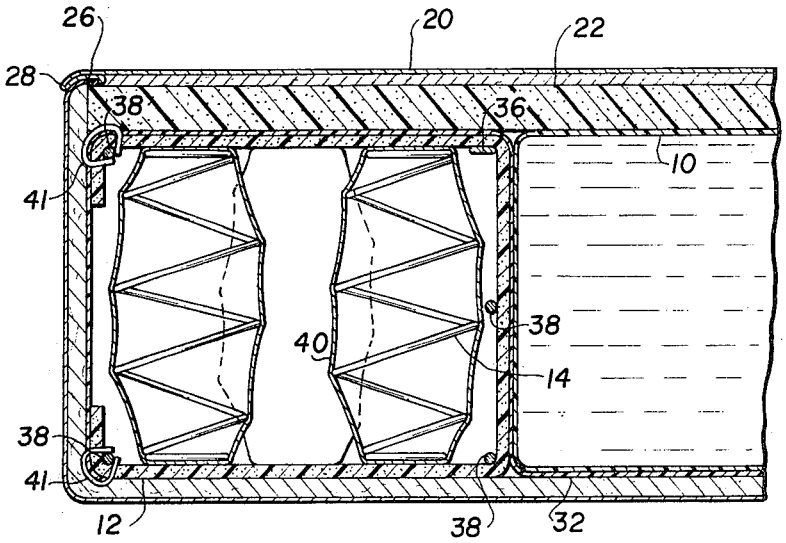
FIG. 2 is a view along the line 2—2 in FIG. 1.

A zipper 26 in the ticking 20 is provided to give access to the valve 18. As best seen in FIGS. 2 and 3, the zipper 26 is preferably located beneath and concealed by a pillow top lip 28. This construction, in addition to giving the flotation mattress 8 a conventional look which enhances its eye appeal, gives easy access to the valve 18 without disturbing the compartment 12. A second zipper 30 is provided at the opposite end of the flotation mattress 8 to provide easy access to the bag 10 from either end of the mattress 8.

The compartment 12 is preferably rectangular in cross-section, two sides of the container being parallel to the plane of the bag 10. While it may be made of various materials, C-foam insulation manufactured by Conwed, Inc. of Dallas, Tex., has been found particularly satisfactory.

A flexible, pan-shaped, ring-like member 32 underlies the bag 10, passes between the bag 10 and the compartment 12, and overlies the compartment 12. The purpose of the member 32 is two-fold. First, it provides a water-impermeable pan to catch the water in the unlikely event that the bag 10 springs a leak. Second, the member 32 provides a buffer between the bag 10 and the compartment 12. The member 32 is preferably made of 12 mil vinyl, which has particularly good frictional wear resistance.

The springs 14 are biconical, or "hour-glass" innersprings such as are used in many conventional mattresses. They are preferably disposed two or three abreast in a continuous, closely spaced array to provide dimensional stability to the bag 10 in the plane of the mattress. As shown in FIG. 6, the springs 14 are held in place by hog rings 34 connecting all or selected ones of the springs 14 to border wires 36 and 38 to shape the springs into an annular assembly and give the assembly a lateral stability while permitting a vertical resiliency. As best seen in FIG. 2, the top inside border wire 36 is rectangular in cross-section with its long flat side parallel to the surface of the bed in order to reduce the possibility of its being felt from the surface of the bed, while the top outside and lower border wires 38 are circular in cross-section. Also as best seen in FIG. 2, one border wire 38 is provided at the top and one border wire 38 is provided at the bottom in the compartment 12 adjacent to its outer side (i.e., on the left in FIG. 2), but three border wires are provided in the compartment 12 adjacent to its inner side (i.e., on the right in FIG. 2)—one border wire 36 at the top, one border wire 38 at the bottom, and one border wire 38 in the middle.

The springs 14 are enclosed in cloth pockets 40 made from two parallel strips of cloth joined along the edges and between adjacent springs. This type of spring is known in conventional innerspring mattresses.

As best seen in FIG. 2, the member 32 and the compartment 12 are also anchored to the border wires 38 by hog rings 41. Where the compartment 12 is open on the outside, as is the FIG. 2 embodiment, the hog rings 41 conveniently connect the outer border wires 38 to facing, turned over edge of the compartment 12.

Turning to FIGS. 7 and 8, a fragmentary portion of a third embodiment of the subject invention will be seen. In this embodiment, the coil springs 14 are replaced by arcuate springs 42 carried by border wires 44 disposed within a compartment 12 (not shown). Arcuate springs 42 perform the same function as coil springs 14, illustrating that the particular type of spring used in the container 12 is of no consequences so long as its axis of resiliency is perpendicular to the plane of the bag 10 and its degree of resiliency is such that the springs approximate the feel of the bag 10.

To insure that the upper edges of the springs 42 are not felt by the user of the mattress, a flexible layer of plastic 46 is provided overlying the springs 42. As shown in FIG. 8, grooves 48 are provided in the underside of the plastic 46 to accept the upper edge of the springs 42.

Turning to FIGS. 9 and 10, a fragmentary portion of a fourth embodiment of the subject invention will be seen. This embodiment is similar in many respects to the embodiment of FIGS. 1 and 2, and the same reference numbers are used where appropriate. It differs from the embodiment of FIGS. 1 and 2, however, in that a plurality of springs 50 are disposed within the bag 10 with their axes of resiliency perpendicular to the plane of the bag and biasing the bag 10 towards its fully inflated position. The purpose of the springs 50 is to prevent "bottoming out," which has been another problem which has plagued the prior art. In particular, since the water within a water mattress readily shifts about, when the level of the water within a mattress gets low it is sometimes possible to feel the mattress support (such as the framework 16), especially when one sits down or shifts position suddenly on the bed. Another purpose of the springs 50 is to reduce "wave motion" within the bag 10. This function the springs 50 accomplish by serving as baffles, interrupting the movement of water within the bag 10.

As shown, the springs 50 in this embodiment are preferably coil springs the two ends of which are anchored to planar meshes 52 by means of plastic helical-type fasteners 54 to prevent lateral movement of the springs. Although not shown, the coil springs can be anchored at one end only, and the anchoring function can be achieved by means other than the illustrated planar meshes 52. Also, the coil spring 50 can, of course, be replaced by other types of springs.

Turning to FIGS. 11 and 12, fragmentary portions of a fifth embodiment of the subject invention will be seen. This embodiment, too, is similar in many respects to the embodiment of FIGS. 1 and 2, and the same reference numbers are again used where appropriate. It differs from the embodiment of FIGS. 1 and 2 in that the pocketed biconical coil springs 14 are replaced by unpocketed biconical coil springs 56 connected by helical fasteners 58 and in that the rectangular upper inner border wire 36 is replaced by a conventional round upper inner border wire 38.

ADVANTAGES OF THE INVENTION

From the foregoing description of a waterbed in accordance with five preferred embodiments of the invention, those skilled in the art will recognize several advantages which singularly distinguish the subject invention from previously known waterbeds. Some of those advantages are set forth below. However, while the following list of advantages is believed to be both accurate and representative, it does not purport to be exhaustive.

A particular advantage of the disclosed waterbeds are that they offer the benefits of conventional water flotation units without the principle drawbacks thereof. In particular, they prevent lateral expansion without the use of rigid members. Additionally, the mattresses herein disclosed substantially improve the feel of uniformity throughout the entire sleeping surface of the mattress.

A further advantage of the disclosed waterbeds is that they have a comfortable sitting edge, the resiliency of which does not degrade with use. This sitting edge also facilitates getting off and on the bed. (This seemingly simple maneuver can be difficult with a conventional "bordered" waterbed, in which the motion can be described as getting "in and out" rather than "off and on.")

A further advantage of the disclosed waterbeds is that they can be adapted for use with a standard metal frame with a central support. This allows the use of most headboards, thereby permitting retention of present decor and the matching of future decor changes. It also facilitates the moving of the waterbed to permit cleaning and the rearrangement of bedroom furniture.

A further advantage of the disclosed waterbeds is that they can be shipped like conventional boxsprings and mattresses and can be set up by the user in one-half hour total set-up time, including filling the bag with water.

A further advantage of the disclosed waterbeds is that they will not sag or indent, thereby eliminating the need for turning the mattress. Also, the firmness of the mattress can be easily adjusted by altering the water level in the mattress, thereby accommodating the preferences of different users.

A still further advantage of the disclosed waterbeds is that they eliminate excessive wave motion which is intolerable to many prospective users.

Caveat

While the present invention has been illustrated by detailed descriptions of four preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

What is claimed is:

1. A waterbed mattress comprising:
(a) a planar, flexible bag adapted to hold water during use thereof and having a generally vertical peripheral side wall;
(b) a vertically resilient annular spring assembly disposed about and surrounding said peripheral side wall in the plane of said bag, said assembly having an inner wall juxtaposed in close proximity to said side wall; and
(c) means, operatively connected to said annular spring assembly, said means being adapted to prevent the lateral expansion of said bag.

2. The mattress of claim 1 wherein said spring assembly includes a plurality of closely spaced springs having their axes of resiliency perpendicular to the plane of said bag.

3. The mattress of claim 2 wherein said means includes a plurality of border wires connected to at least some of said springs.

4. A waterbed mattress comprising:
(a) a planar, flexible bag adapted to hold water during use of the mattress;
(b) an annular compartment surrounding said bag in the plane of said bag, said annular compartment being collapsible in the direction perpendicular to the plane of said bag;
(c) a plurality of springs disposed in said compartment with their axes of resiliency perpendicular to the plane of said bag, said springs biasing said compartment to its uncollapsed position; and
(d) means in said annular compartment adapted to prevent the lateral expansion of said bag.

5. A mattress as recited in claim 4 wherein said compartment is rectangular in cross-section, two sides of the compartment being parallel to the plane of said bag.

6. A mattress as recited in claim 4 wherein said springs are arcuate springs.

7. A mattress as recited in claim 6 wherein said means comprise border wires connected to said arcuate springs.

8. A mattress as recited in claim 6 and further comprising a flexible member overlying said springs to insure that the upper edges of the springs are not felt by the user of the mattress.

9. A mattress as recited in claim 8 wherein grooves are provided in the underside of said flexible member to accept the upper edges of said springs.

10. A flotation unit comprising a mattress as recited in claim 4 disposed on a framework which maintains the mattress off the floor during use.

11. A mattress as recited in claim 4 and further comprising a protective liner which entirely surrounds said bag and said compartment and which is substantially inelastic, serving to prevent lateral expansion of the mattress when someone sits or lies on it.

12. A mattress as recited in claim 4 and further comprising a flexible, pan-shaped member which underlies said bag, passes between said bag and said compartment, and overlies said compartment.

13. A mattress as recited in claim 4 and further comprising resilient padding overlying said bag.

14. A mattress as recited in claim 13 wherein said resilient padding surrounds said bag and said compartment.

15. A mattress as recited in claim 4 and further comprising a plurality of springs disposed within said bag with their axes of resiliency perpendicular to the plane of said bag and biasing said bag towards its fully inflated position.

16. A mattress as recited in claim 15 wherein said springs disposed within said bag are coil springs.

17. A mattress as recited in claims 15 or 16 wherein said springs disposed within said bag are anchored at at least one end.

18. A mattress as recited in claim 16 wherein said coil springs are anchored at at least one end to a planar mesh.

19. A mattress as recited in claim 18 wherein said coil springs are anchored at at least one end to a planar mesh by means of helical fasteners.

20. A mattress as recited in claims 18 or 19 wherein said coil springs are so anchored at both ends.

21. A mattress as recited in claim 4 wherein said means comprise border wires connected to said springs.

22. A waterbed mattress comprising:

(a) a planar, flexible bag adapted to hold water during use of the mattress;

(b) an annular compartment surrounding said bag in the plane of said bag, said annular compartment being collapsible in the direction perpendicular to the plane of said bag;

(c) a plurality of springs disposed in said compartment with their axes of resiliency perpendicular to the plane of said bag, said springs biasing said compartment to its uncollapsed position; and (d) at least one border wire located in said compartment.

23. A mattress as recited in claim 22 wherein said springs are connected to said border wire.

24. A waterbed mattress comprising:

(a) a planar, flexible bag adapted to hold water during use of the mattress;

(b) a plurality of springs disposed peripherally about and surrounding said bag with their axes of resiliency perpendicular to the plane of said bag;

(c) a plurality of border wires; and (d) connectors interconnecting said plurality of springs with said border wires in a fashion not to diminish substantially the resiliency of said springs along said axes of resiliency.

25. The mattress of claim 24 wherein an inelastic flexible ticking envelops said bag and springs, wherein said ticking together with said springs and said border wires, gives a dimensional stability to said mattress.

26. A mattress as recited in claim 24 where an annular rectangular compartment houses said springs and two sides of the compartment are parallel to the plane of said bag.

27. A mattress as recited in claim 24 wherein said springs are arcuate springs carried by said border wires.

28. A mattress as recited in claim 24 and further comprising a flexible member overlying said springs and said bag to insure that the springs are not felt by the user of the mattress.

29. A mattress as recited in claim 28 wherein grooves are provided in the underside of said flexible member to accept the upper edges of said springs.

* * * * *